US008567460B1

(12) United States Patent
Lentsch

(10) Patent No.: US 8,567,460 B1
(45) Date of Patent: Oct. 29, 2013

(54) CREDIT CARD HOLDER

(76) Inventor: Allen Lentsch, Burnsville, MN (US)

( * ) Notice: Subject to any disclaimer, the term of this patent is extended or adjusted under 35 U.S.C. 154(b) by 108 days.

(21) Appl. No.: 13/506,004

(22) Filed: Mar. 21, 2012

(51) Int. Cl.
*A45C 11/18* (2006.01)

(52) U.S. Cl.
USPC ..... 150/147; 206/39.5

(58) Field of Classification Search
USPC ..... 150/137, 147–149; 206/37, 38, 39, 206/39.5; 24/336
See application file for complete search history.

(56) References Cited

U.S. PATENT DOCUMENTS

| | | | | |
|---|---|---|---|---|
| 3,068,923 | A * | 12/1962 | Wolf | 150/138 |
| 5,077,869 | A * | 1/1992 | Haase | 24/336 |
| 5,115,909 | A * | 5/1992 | Hull et al. | 206/38 |
| 2008/0178976 | A1 * | 7/2008 | Lakhiani | 150/137 |
| 2011/0042133 | A1 * | 2/2011 | Lythcott | 174/377 |

* cited by examiner

*Primary Examiner* — Sue A Weaver
(74) *Attorney, Agent, or Firm* — Thomas B. Tate

(57) ABSTRACT

A credit card holder made from a generally rectangular sheet of aluminum that is folded back upon itself so that the bottom is closed, while the top and both sides have slit-like openings between the front and the back of the holder. A pair of generally congruent indentations are formed into the right side and a pair of offset indentations are formed into the top of the holder.

1 Claim, 2 Drawing Sheets

FIG. I

CREDIT CARD HOLDER

BACKGROUND OF THE INVENTION

The field of the invention is credit card holders.

Most credit card holders on the market today are a paper or plastic sleeve that holds one or two credit cards (for purposes of this specification, the term "credit cards" also includes debit cards, charge cards, and the like). Some conventional leather billfolds are also made with slots for holding credit cards. A problem with these prior art holders is that identity thieves can walk by a person and use a scanner to scan that person's credit card numbers. The only material (other than water) that can block scanning is aluminum, and to that effect aluminum billfolds are currently available. However, aluminum billfolds are hard and therefore uncomfortable to sit on. No aluminum credit card holders are known to exist in the prior art. Credit card holders with indentations are not known to exist in the prior art.

SUMMARY OF THE INVENTION

The credit card holder disclosed herein is formed from a generally rectangular sheet of aluminum that is folded back upon itself so that the bottom end is closed, and the front and back surfaces define slit-like openings between them on the top and both sides. Indentations are provided along the top and the right side.

An advantage of the invention is that the holder provides the anti-scanning security of aluminum without the discomfort of an aluminum billfold.

Another advantage of the invention is that the holder fits easily into a billfold so that a credit card can be removed for use without removing the holder from the billfold.

Another advantage of the invention is that credit cards can be slid into the holder from either side or can be put into the holder by spreading apart the top.

Another advantage of the invention is that the holder can hold up to three credit cards comfortably.

DETAILED DESCRIPTION OF THE INVENTION

Figure 1:
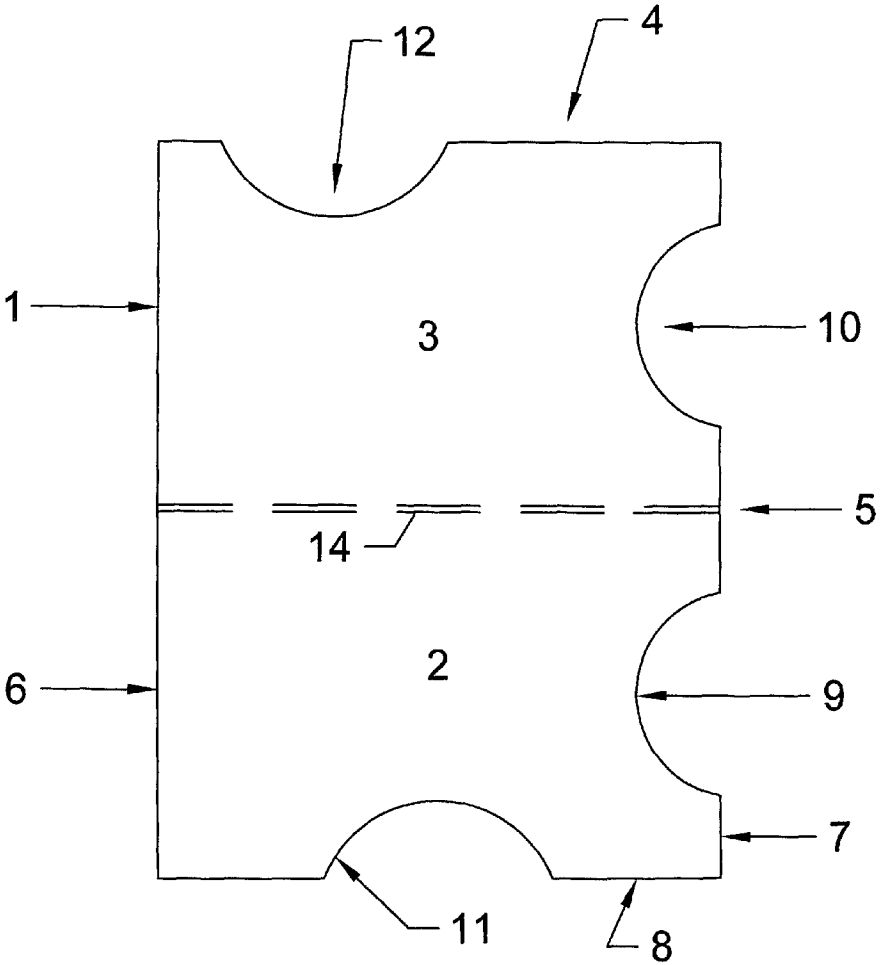
FIG. 1 is a top view of the credit card holder laid out flat before it is folded into position.
Figure 2:
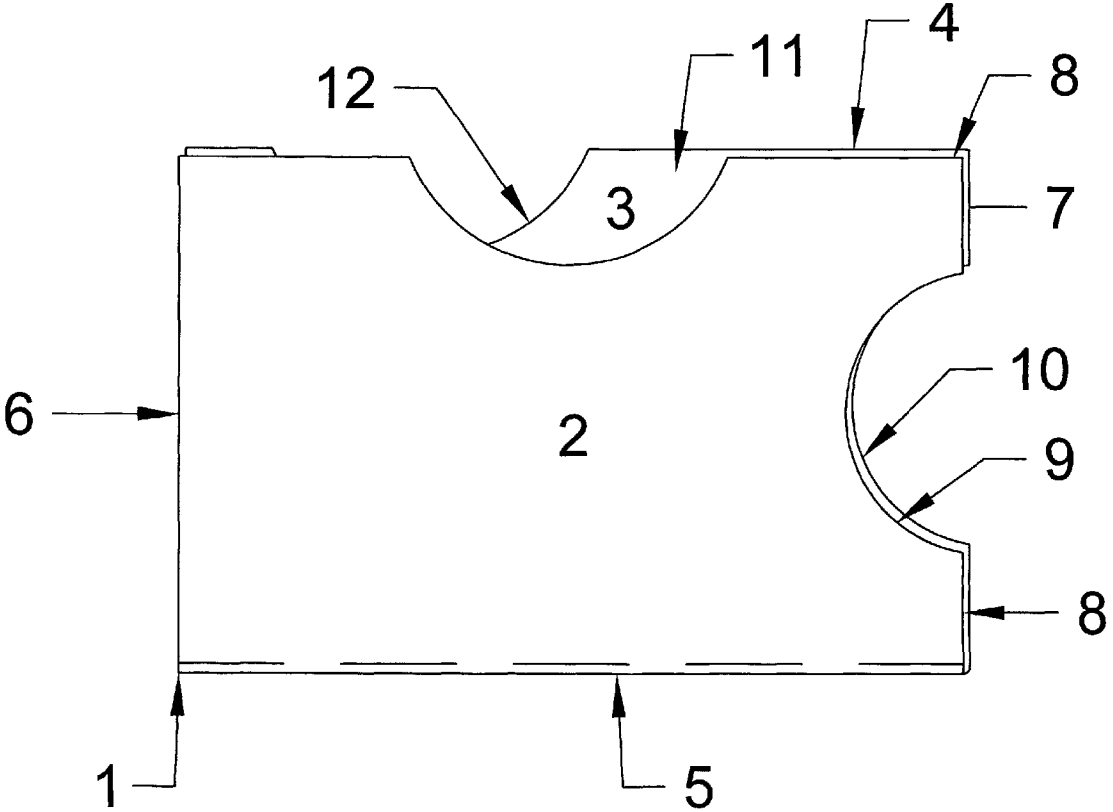
FIG. 2 is a front perspective view of the credit card holder ready for use.

The credit card holder has a generally rectangular main body 1 having a front 2, a back 3, a top 4, a bottom 5, a left side 6, and a right side 7. The front 2 and back 3 are longer along the top 4 and bottom 5 than along the sides 6 and 7.

The main body 1 is formed from a thin sheet of aluminum that is folded back upon itself along generally parallel bend lines 14 that define the bottom 5. The bottom 5 is closed and is formed into a generally U-shaped curve. The front 2 and the back 3 are generally flat surfaces. The top 4, the left side 6, and the right side 7 are the respective edges of the front 2 and the back 3. A slit-like opening 8 is defined between the front 2 and the back 3. On the top 4, the slit-like opening 8 is generally straight across, while on the left side 6 and the right side 7 the slit-like opening 8 is wider toward the bottom 5 and tapers slightly toward the top 4 in order to hold credit cards securely between the front 2 and the back 3. The opening 8 extends internally the entire distance between the front 2 and the back 3 above the bottom 5.

Four generally semi-circular indentations are formed into the main body 1 in order to make it easier to insert credit cards into, and remove credit cards from, the holder. A first indentation 9 is formed into the right side 7 of the front 2 and is generally congruent with a second indentation 10 formed into the right side 7 of the back 3. A third indentation 11 formed into the top 4 of the front 2 is offset with respect to a fourth indentation 12 formed into the top 4 of the back 3.

To use the credit card holder, credit cards can be slid into or out of the opening 8 from either the left side 6 or the right side 7, or the top 4 can be spread apart to widen the opening 8 between the front 2 and the back 3 to allow credit cards to be inserted or removed. The credit card holder can hold up to three credit cards comfortably.

I claim:

1. A credit card holder comprising:

a generally rectangular main body having a front, a back, a top, a bottom, a left side, and a right side, said main body being formed from a thin sheet of aluminum that is folded back upon itself along generally parallel bend lines that define said bottom, said front and said back having generally flat surfaces;

a slit-like opening defined between said front and said back along said top, said left side, and said right side, said opening along said left side and said right side tapering slightly toward said top in order to hold credit cards in position between said front and said back;

a first generally semi-circular indentation formed into said right side of said front and a second generally semi-circular indentation formed into said right side of said back, said first indentation and said second indentation being generally congruent;

a third generally semi-circular indentation formed into said top of said front and a fourth generally semi-circular indentation formed into said top of said back, said third indentation and said fourth indentation being offset with respect to each other.

* * * * *